US008961327B1

(12) United States Patent
Hutchinson et al.

(10) Patent No.: US 8,961,327 B1
(45) Date of Patent: Feb. 24, 2015

(54) SHARP SHOOTER BILLIARDS SYSTEMS

(71) Applicants: Garry Hutchinson, Cameron (CA); Robert Serksnas, Millbrook (CA)

(72) Inventors: Garry Hutchinson, Cameron (CA); Robert Serksnas, Millbrook (CA)

( * ) Notice: Subject to any disclaimer, the term of this patent is extended or adjusted under 35 U.S.C. 154(b) by 6 days.

(21) Appl. No.: 13/954,177

(22) Filed: Jul. 30, 2013

Related U.S. Application Data

(60) Provisional application No. 61/678,919, filed on Aug. 2, 2012.

(51) Int. Cl.
*A63D 15/00* (2006.01)

(52) U.S. Cl.
CPC ..... *A63D 15/00* (2013.01); *A63D 15/003* (2013.01); *A63D 15/005* (2013.01); *A63D 15/006* (2013.01)
USPC ..... 473/20

(58) Field of Classification Search
CPC ... A63D 15/00; A63D 15/003; A63D 15/005; A63D 15/006
USPC ..... 473/1, 3, 4, 17, 18, 19, 20, 28; 273/123 R, 118 R; D21/312, 783, 782
See application file for complete search history.

(56) References Cited

U.S. PATENT DOCUMENTS

| | | | | | |
|---|---|---|---|---|---|
| 242,584 | A | * | 6/1881 | Bensinger | 273/123 R |
| 289,217 | A | | 11/1883 | Caldee et al. | |
| 458,065 | A | * | 8/1891 | Patillo | 473/17 |
| 462,843 | A | * | 11/1891 | Kavanagh | 473/17 |
| 560,739 | A | * | 5/1896 | Mumbrauer | 473/17 |
| 685,596 | A | * | 10/1901 | Genter et al. | 473/17 |
| 769,286 | A | * | 9/1904 | Zeip | 273/120 R |
| 830,180 | A | * | 9/1906 | Schultz | 273/123 R |
| 875,015 | A | * | 12/1907 | Upton | 473/17 |
| 1,157,053 | A | * | 10/1915 | Smith | 473/41 |
| 1,176,367 | A | * | 3/1916 | Jackson | 273/119 R |
| 1,231,608 | A | * | 7/1917 | Holdredge | 273/115 |
| 1,245,820 | A | * | 11/1917 | Teruya | 273/123 R |
| 1,468,336 | A | * | 9/1923 | Vondersloot | 273/123 R |
| 1,506,369 | A | * | 8/1924 | Guinan | 273/123 R |
| 1,784,068 | A | * | 12/1930 | Johnson | 473/17 |
| D83,747 | S | | 3/1931 | Pavelka et al. | |
| 1,801,142 | A | * | 4/1931 | Crosthwait | 473/19 |
| D90,752 | S | * | 9/1933 | Deming | D21/312 |
| 3,141,673 | A | * | 7/1964 | Scott | 473/19 |
| 3,429,574 | A | * | 2/1969 | Williams | 273/123 R |
| 3,765,678 | A | * | 10/1973 | Greaney | 273/119 R |
| 3,958,804 | A | | 5/1976 | Godfrey | |
| 3,976,294 | A | * | 8/1976 | Maldonado | 473/20 |
| 4,017,079 | A | * | 4/1977 | Apellaniz | 273/126 R |
| 4,183,525 | A | * | 1/1980 | De Marco, Jr. | 473/20 |
| D262,896 | S | * | 2/1982 | Dabbs | D21/312 |
| 6,319,141 | B1 | | 11/2001 | Cartee | |
| D629,483 | S | | 12/2010 | Davis | |

* cited by examiner

*Primary Examiner* — Mitra Aryanpour
(74) *Attorney, Agent, or Firm* — RG Patent Consulting, LLC; Rachel Gilboy

(57) ABSTRACT

A billiard table useful for entertaining that may be set up against a wall, for people to play the novel billiard-style game from only one side (end). The table may have two bowed leg stands. The two stands may be bolted or otherwise affixed to the underside of the table. The table may be made out of plywood and oak with a felt playing surface. Pockets with designated numbers may run along the top and the bottom of the table. Players may call their shot, set up the ball, and then aim for the corresponding pocket. If the player sinks the ball into the called pocket, the ball will return to the front of the table in the same numbered pocket to easily keep track of the score. The device saves room and involves a great deal of strategy to play.

19 Claims, 5 Drawing Sheets

SHARP SHOOTER BILLIARDS SYSTEMS

CROSS-REFERENCE TO RELATED APPLICATION

The present application is related to and claims priority from prior provisional application Ser. No. 61/678,919, filed Aug. 2, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of games and more specifically relates to a billiard game and method of playing the billiard game comprising a specialty billiard table having a plurality of pockets with different point values located at one side of the table.

2. Description of the Related Art

People of all ages enjoy playing games such as pool or billiards. Not a lot of people, however, have enough space in their homes to set up a pool table. Further, not only do they have to have enough space for the table, but they also have to be able to walk the entire way around the perimeter of the table. Some people may have enough room for the table, but their pool sticks still hit the wall when they try to shoot the ball. This can be frustrating, can impede their shot, and can also cause damage to the wall. An effective game solution is necessary that is unlike traditional billiard tables.

Various attempts have been made to solve the above-mentioned problems such as those found in U.S. Pat. No. 6,319,141 to James Ronald Cartee; U.S. Pat. No. 4,183,525 to De Marco John Jr.; D83,747 to F. E. Pavelka et al; U.S. Pat. No. 3,958,804 to Eric G. Godfrey; 289,217 to George Calder; and D629,483 to Delroy Davis. This prior art is representative of billiard games. None of the above inventions and patents, taken either singly or in combination, is seen to describe the invention as claimed.

Ideally, a sharp shooter billiards system should provide entertainment, and, yet would operate reliably and be manufactured at a modest expense. Thus, a need exists for a reliable sharp shooter billiards system to avoid the above-mentioned problems.

BRIEF SUMMARY OF THE INVENTION

In view of the foregoing disadvantages inherent in the known billiards game art, the present invention provides a novel sharp shooter billiards system comprising a novel pool table comprising a playing surface having a plurality of point-value pockets.

The general purpose of the present invention, which will be described subsequently in greater detail, is to provide a standard-sized pool table with pockets along one end of the table. Pool players may set up the head of the table against a wall, and then play from the other end, thereby reducing the amount of the space needed to set up the table. By using this novel pool table, pool players may perfect their shooting, aim, and accuracy while playing a fun and competitive game without needing a lot of space. Sharp shooter billiards systems may be ideal for play of all ages and skill levels, and may accommodate groups of two or more players.

Sharp shooter billiards systems are disclosed herein in a preferred embodiment comprising a billiard table having dimensions of approximately 4' by 8'. The billiard table may comprise a billiard table frame, a playing surface manufactured from felt and comprising a peripheral rail, a head-end wall comprising a first corner, a second corner, and a midpoint, the head-end wall further comprising a plurality of head-end wall point-value pockets. The peripheral rail of the head-end wall may comprise at least one bumper located between each of the head-end wall point-value pockets. The billiard table may further comprise a shooting-end wall, the shooting-end wall of the billiard table is placeable directly adjacent a vertical wall in an interior room thereby conserving space during play. The billiard table further comprises a left-side wall having a left-side wall point-value pocket, a right-side wall having a right-side wall point-value pocket, and a pair of billiard table legs preferably comprising bowed leg stands, the pair of billiard table legs bolted to an underside of the billiard table via a pair of bolts for upright support.

The sharp shooter billiards system in preferred embodiments further comprises a ball return assembly comprising a plurality of ball returns, a plurality of point denomination through-holes, a ledge, and a ball retaining rack. The billiard table and the ball return assembly comprises in combination the sharp shooter billiards system. The plurality of ball returns, the plurality of point denomination through-holes, the ledge, and the ball retaining rack comprises in combination the ball return assembly.

With particular reference to the billiard table of the sharp shooter billiards system, the head-end wall, the left-side wall, the shooting-end wall, and the right-side wall define parameters of the billiard table frame. The playing surface may be recessed within the billiard table frame. The peripheral rail of the playing surface may be in contact with the head-end wall, the shooting-end wall, the left-side wall, and the right-side wall. The peripheral rail may comprise a plurality of billiard ball openings which may provide ingress for at least one billiard ball to enter. The billiard ball openings may be adjacent the plurality of head-end wall point-value pockets, the left-side wall point-value pocket, and the right-side wall point-value pocket.

Further, the head-end wall point-value pockets, the left-side wall point-value pocket, and the right-side wall point-value pocket are connected to the plurality of ball returns. The plurality of ball returns are connected to the plurality of point denomination through-holes, and the point denomination through-holes allow the made billiard balls to pass therethrough onto the ledge during game-play. It should be appreciated that the plurality of head-end wall point-value pockets, the left-side wall point-value pocket, and the right-side wall point-value pocket are located on a higher plane than the ledge of the ball return assembly such that gravity may cause the made billiard ball to roll downward from the plurality of head-end wall point-value pockets, the left-side wall point-value pocket, and the right-side wall point-value pocket to the ledge for easy access.

According to the preferred embodiment, at least two of the plurality of head-end wall point-value pockets comprises 25-point pockets (such that a shot made in one of these two pockets is worth 25 points). The 25-point pockets may be each located at the first corner between the head-end wall and the left-side wall, and the second corner between the head-end wall and the right-side wall. At least two of the plurality of head-end wall point-value pockets comprise 5-point pockets (such that a shot made in one of these two pockets is worth 5 points). Each of the 5-point pockets may be located adjacent the 25-point pockets. At least one of the head-end wall point-value pockets comprises a 10-point pocket (such that a shot made in this pocket is worth 10 points), the 10-point pocket may be located at the mid-point of the head-end wall. At least one of the head-end wall point-value pockets may comprise a 20-point pocket (such that a shot made in this pocket is worth 20 points). The 20-point pocket may be located to a left of the mid-point between the 10-point pocket and the 5-point pocket. At least one of the head-end wall point-value pockets may comprise a 15-point pocket (such that a shot made in this pocket may be worth 15 points), the 15-point pocket located to a right of the mid-point between the 10-point pocket and the 5-point pocket. Furthermore, the left-side wall point-value pocket and the right-side wall point-value pocket may comprise 50-point pockets, (such that a shot made in one of these two pockets is worth 50 points).

It should be noted that the billiard balls which have been played or otherwise not in use may be displayable on the ball retaining rack. The billiard table legs support the billiard table above a planar surface such as a floor. A billiard-style game may be comprised of shooting the billiard ball(s) into the plurality of billiard ball openings by at least one player for accumulating points, and the player that accumulates the most the points played over a pre-determined duration wins the game.

The sharp shooter billiards system may further comprise a kit which may include the (specialty) billiard table, the pair of billiard table legs, the bolts for mounting the billiard table to the billiard table legs, a set of balls, and a set of user instructions.

A method of playing a billiard-style game on a billiard table of a sharp shooter billiards system between two or more players may comprise the steps of: step one, starting a game with two billiard balls on a billiard table; step two, placing a third ball on the billiard table to use as a cue ball; step three, calling a billiard ball in-play by the player whose turn it is; step four, striking the cue ball into the billiard ball in-play called by the player; step five, sinking the billiard ball in-play into a point-value pocket; and step five, accumulating points to win the billiard-style game.

The present invention holds significant improvements and serves as a sharp shooter billiards system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, sharp shooter billiards systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a sharp shooter billiards system and more particularly to a billiard table with pockets along an end wall of the table. Players may set up a head of the billiard table against a wall, and then play from the other end, thereby reducing the amount of the space needed to set up the billiard table.

Generally speaking, sharp shooter billiards systems may comprise a unique and novel billiard table which may use less space than a traditional pool table, without compromising the game's integrity. This unique billiard table may comprise a standard-sized pool table with a 4' by 8' playing surface. The billiard table may be set up against a wall, as people may play the novel billiard-style game from only one side (end). The table may comprise two bowed leg stands. The two stands may be bolted or otherwise affixed to the underside of the table. The table may be made out of plywood and oak with a felt playing surface. Pockets with designated numbers may run along the top and the bottom of the table. Players may call their shot, set up the ball, and then aim for the corresponding pocket. If the player sinks the ball into the called pocket, the ball will return to the front of the table in the same numbered pocket to easily keep track of the score. There may be a lower rack below the table of out-of-play balls.

Figure 1:
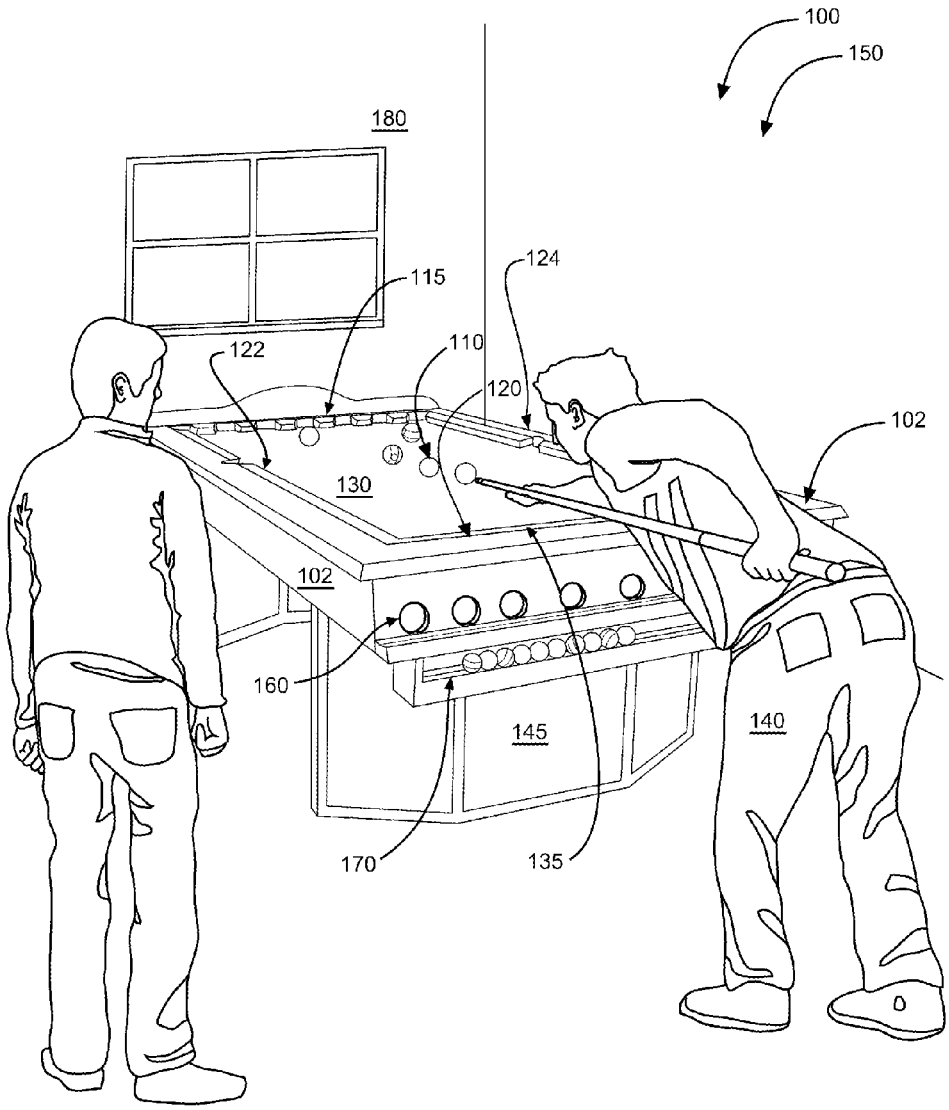
FIG. 1 shows a perspective view illustrating sharp shooter billiards systems during an 'in-use' condition comprising a billiard table positioned up against a vertical wall thereby conserving space according to an embodiment of the present invention.

Referring now to the drawings more specifically by numerals of reference there is shown in FIG. 1, sharp shooter billiards systems 100 during 'in-use' condition 150 according to an embodiment of the present invention. As shown, sharp shooter billiards systems 100 may comprise billiard table 102 which may generally comprise a standard billiard table dimensions having a unique and novel pocket configuration. Sharp shooter billiards systems 100 may comprise billiard table 102. Billiard table 102 may generally comprise billiard table frame 105, playing surface 130, head-end wall 115 comprising a first corner, a second corner, and a mid-point, shooting-end wall 120, left-side wall 122 comprising left-side wall point-value pocket 210, right-side wall 124 comprising right-side wall point-value pocket 215, and billiard table legs 145. Further, head-end wall 115 comprises plurality of head-end wall point-value pockets 205. Playing surface 130 may comprise peripheral rail 135 in preferred embodiments.

Figure 3:
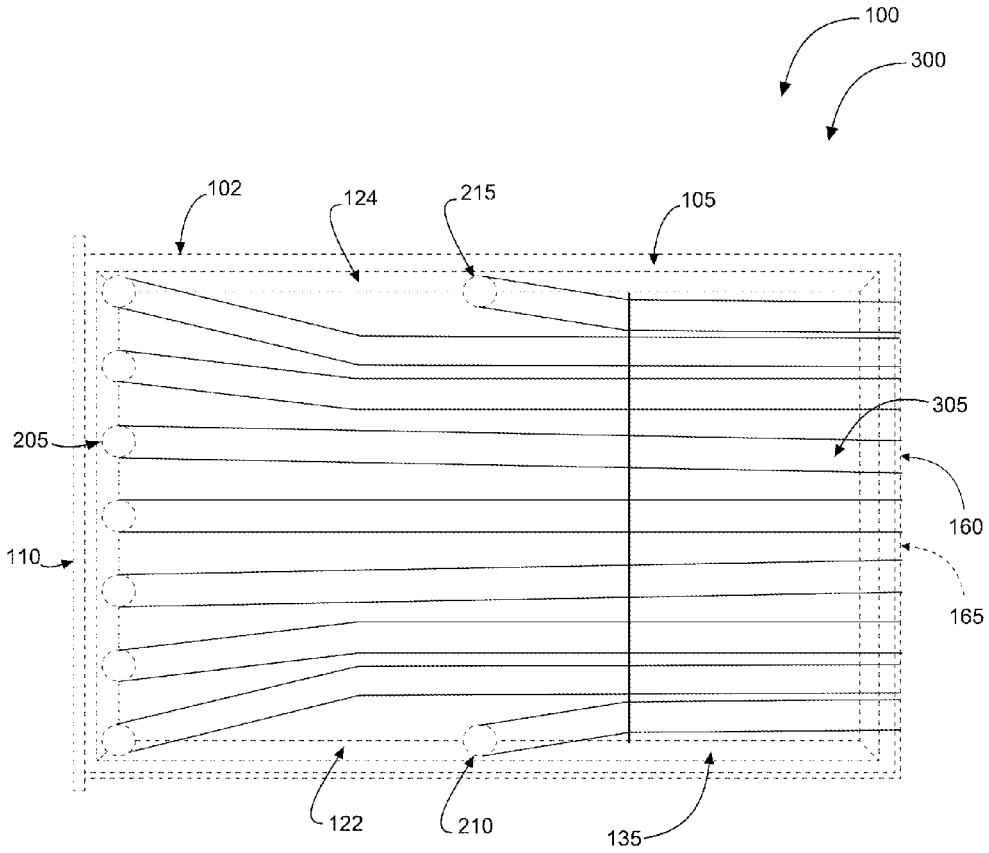
FIG. 3 is an interior perspective view the billiard table showing a ball return assembly according to an embodiment of the present invention of FIGS. 1-2.

In still referring to FIG. 1, sharp shooter billiards systems 100 may also comprise ball return assembly 300 (shown in detail in FIG. 3). Ball return assembly 300 may comprise plurality of ball returns 305, plurality of point denomination through-holes 160, ledge 165, and ball retaining rack 170. Billiard table 102 and ball return assembly 300 as such comprises in combination sharp shooter billiards systems 100. Plurality of ball returns 305, plurality of point denomination through-holes 305, ledge 165, and ball retaining rack 170 comprises in combination ball return assembly 300.

As shown in FIG. 1, billiard table frame 105 may have parameters defined by head-end wall 115, shooting-end wall 120, left-side wall 122, and right-side wall 124. Playing surface 130 may comprise felt which may be recessed within the billiard table frame 105. Further, peripheral rail 135 of playing surface 130 may be in contact with head-end wall 115, shooting-end wall 120, left-side wall 122, and right-side wall 124. In one embodiment, billiard table 102 may comprise dimensions of approximately 4' by 8'. It should be appreciated however that billiard table 102 may comprise alternate dimensions to appeal to a variety of players 140. Billiard table 102 may be formed of plywood and oak. Alternatively, billiard table 102 may be constructed of a variety of woods such as mahogany, birch, and others.

Figure 4A:
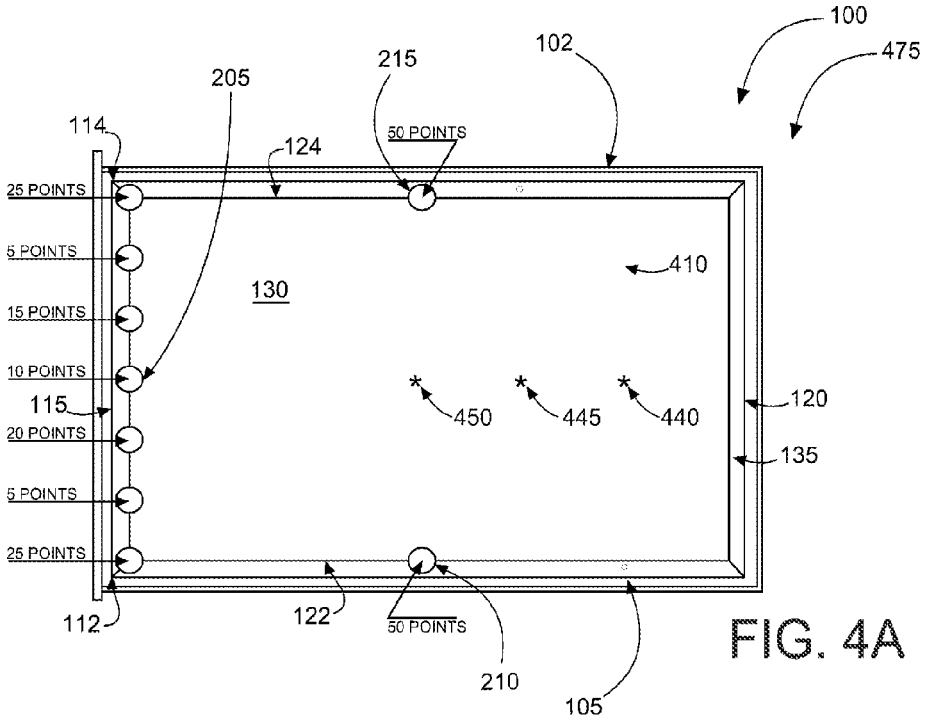
FIG. 4A is a perspective view illustrating the billiard table comprising a plurality of head-end wall point-value pockets, a left-side wall point-value pocket, and a right-side wall point-value pocket of sharp shooter billiards systems according to an embodiment of the present invention of FIG. 1-3.
Figure 4B:
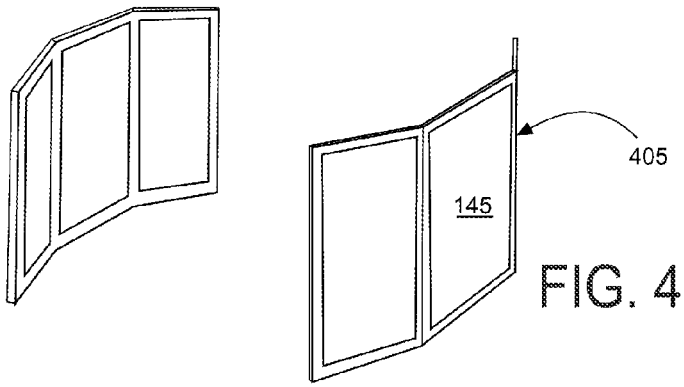
FIG. 4B is a perspective view illustrating the pair of billiard legs comprising bowed legged stands according to an embodiment of the present invention of FIG. 1-3.

In still referring to FIG. 1, billiard table 102 of sharp shooter billiards systems 100 may also comprise billiard table legs 145 (also shown in FIG. 4B). Billiard table legs 145 may provide upright support for billiard table frame 105. Billiard table legs 145 support billiard table 102 above a planar surface such as a floor or the like. In addition, billiard table 102 may comprise ball return assembly 300 (as shown better in FIG. 3). Ball return assembly 300 may return billiard ball 110 that has been shot into one of the pockets to return to ledge 165 located at shooting-end wall 120 of billiard table 102 for ease of reach.

Figure 2:
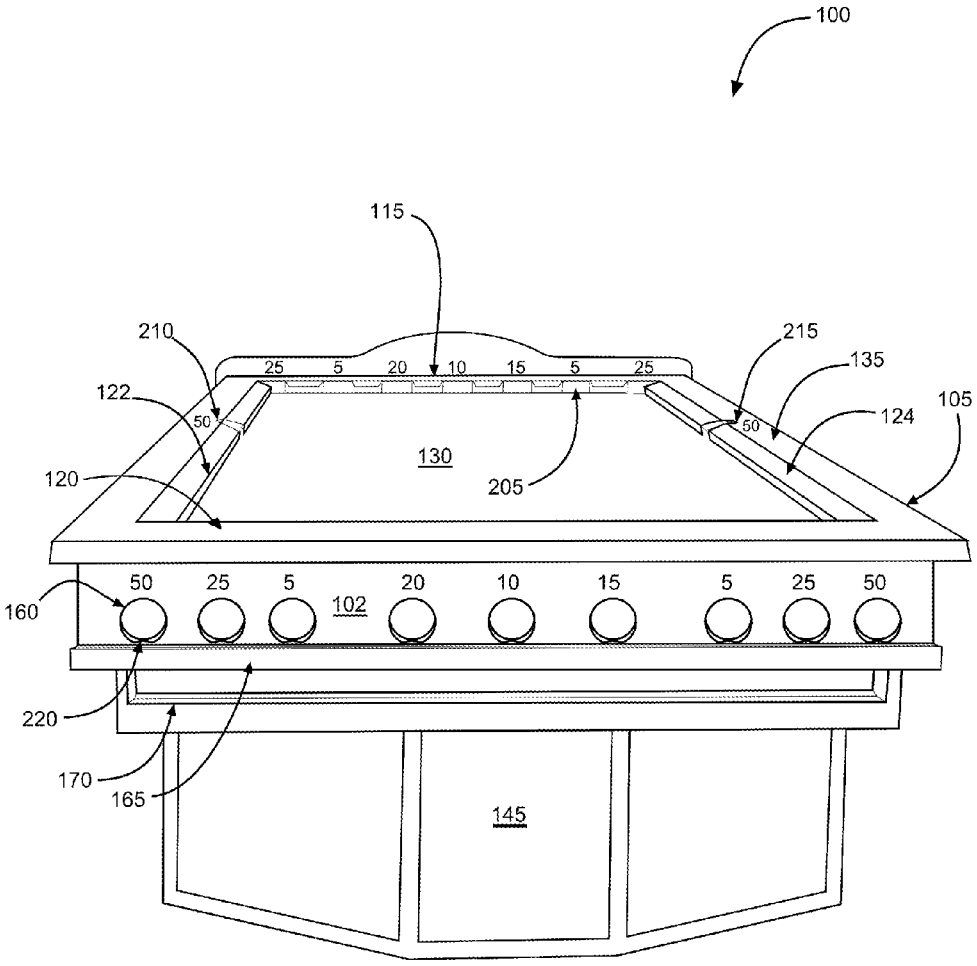
FIG. 2 is a perspective view of the billiard table comprising a billiard table frame, a playing surface, a plurality of point-value pockets, and a pair of billiard legs according to an embodiment of the present invention of FIG. 1.

Referring now to FIG. 2 illustrating a perspective view of billiard table 102 comprising billiard table frame 105, playing surface 130, plurality of head-end wall point-value pockets 205, left-side wall point-value pocket 210, and right-side wall point-value pocket 215, and pair of billiard table legs 145 according to an embodiment of the present invention of FIG. 1. As shown, peripheral rail 135 of playing surface 130 may comprise a plurality of billiard ball openings which may each provide ingress for at least one billiard ball 110 to enter. The billiard ball openings may be adjacent head-end wall point-value pockets 205, left-side wall point-value pocket 210, and right-side wall point-value pocket 215. As shown, billiard ball(s) 110 that are not in use are displayable on ball retaining rack 170.

In continuing to refer to FIG. 2 showing point denomination through-holes 160 of sharp shooter billiards systems 100. Point denomination through-holes 160 may comprise through-holes located above ledge 165 of shooting-end wall 120 of billiard ball 110. As shown, ledge 165 may comprise plurality of ridges 220 located underneath each of point denomination through-holes 160. Ridge 220 may comprise a cutout within ledge 165 which may retain billiard ball 110 after billiard ball 110 passes through point denomination through-holes 160. In such a manner, ridge 220 of ledge 165 may prevent billiard ball 110 from falling to the ground after a shot is made by player 140. It should be noted that point denomination through-holes 160 preferably comprises labels or indicia corresponding to a point value of head-end wall point-value pockets 205, left-side wall point-value pocket 210, and right-side wall point-value pocket 215 for ease in keeping track of points.

Referring now to FIG. 3 illustrating an interior perspective view of billiard table 102 comprising ball return assembly 300 according to an embodiment of the present invention of FIGS. 1-2. As shown, head-end wall point-value pockets 205, left-side wall point-value pocket 210, and right-side wall point-value pocket 215 are connected to plurality of ball returns 305, and plurality of ball returns 305 are connected to plurality of point denomination through-holes 160. Point denomination through-holes 160 may allow billiard ball(s) 110 to pass there-through onto ledge 165. A game is comprised of shooting billiard ball(s) 110 into the plurality of billiard ball openings comprising head-end wall point-value pockets 205, left-side wall point-value pocket 210, and right-side wall point-value pocket 215 by at least one player 140 for accumulating points, and player 140 that accumulates the most points played over a pre-determined duration wins the game.

Referring now to FIG. 4A showing a perspective view illustrating billiard table 102 comprising a plurality of head-end wall point-value pockets 205, a left-side wall point-value pocket 210, and a right-side wall point-value pocket 215 of sharp shooter billiards systems 100 according to an embodiment of the present invention of FIG. 1-3.

Referring now to FIG. 4B showing a perspective view illustrating pair of billiard table legs 145 comprising bowed legged stands 405 according to an embodiment of the present invention of FIG. 1-3. In one embodiment, bow legged stands 405 may be formed of wood and may be used to support billiard table 102.

Figure 4C:
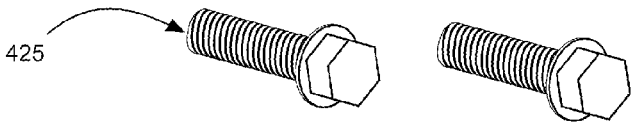
FIG. 4C is a perspective view illustrating a pair of bolts for mounting the pair of billiard legs comprising the bowed legged stands to an underside of the billiard table according to an embodiment of the present invention of FIG. 1-3.

Referring now to FIG. 4C showing a perspective view illustrating a pair of bolts 425 for mounting the pair of billiard table legs 145 comprising bow legged stands 405 to an underside of billiard table 102 according to an embodiment of the present invention of FIG. 1-3.

In one version of playing a billiard-style game on billiard table 102 of sharp shooter billiards system 100, the game may be played by 2 or more player(s) 140 alternating taking turns. The game may start with two billiard balls on billiard table 102 (one cue ball placed on cue-ball spot 440 and a first-game ball on first-game ball spot 445, as shown best in FIG. 4A. Further, to make the game more challenging, a third ball may be placed on second-game ball spot 450. The game may be played by "call shots" or by "fluxes". If the cue ball that player 140 calls the number on sinks or sewers into any of the pockets on billiard table 102, player 140 deducts those points from his/her score. If player 140 sinks the billiard ball called, player 140 earns those points and continues with the next shot. A new shot always begins by placing a new billiard ball from ball retaining rack 170 onto cue-ball spot 440 (to be used as the cue ball), thereby continuously adding new billiard balls to the game. Anytime during the game any billiard ball comes back behind shooting line 410 it is considered out of play and is returned to ball retaining rack 170. If the cue ball shot from cue-ball spot 440 is not sunk and it is in play above shooting line 410, it becomes another ball in play. In one version, this game may be played to scores of 305, 505, or any denominations that equals an even score. To designate the location of cue-ball spot 440, a circular adhesive may be placed approximately 16" from shooting-end wall 120 on playing surface 130 of billiard table 102.

As an example of how the game may function, if player 140 is playing to a score of 305 and has a score of 290 (thereby needing 15 points) and player 140 sinks a ball into a 25 point pocket, then player 140 loses the rest of his/her turn and will need 40 points to win the game.

In another version of playing a billiard-style game on billiard table 102 of sharp shooter billiards system 100, player(s) 140 may alternate taking turns. To begin a game, a first player may place two billiard balls 110 on playing surface 130 of billiard table 102. A third billiard ball 110 may be placed at a center point of shooting line 410. The first player may designate a particular billiard ball 110 in play by calling out that particular billiard ball 110. If the first player sinks that particular billiard ball 110 into one of the billiard ball openings on playing surface 130, the first player is awarded the amount of points designated by that billiard ball opening. However, if the first player scratches by sinking the third billiard ball 110 used as the cue ball for that particular shot, the first player would deduct the amount of points designated by the billiard ball opening that the cue ball fell into. Missing a shot or scratching the cue ball ends the first player's turn and the second player would then shoot. A new billiard ball 110 may be removed from ball retaining rack 170 to begin each turn, thereby adding another billiard ball 110 to the game each round. If player 110 makes the shot that player 110 calls out, player 110 is awarded the points and continues to shoot in a similar manner.

Figure 5:
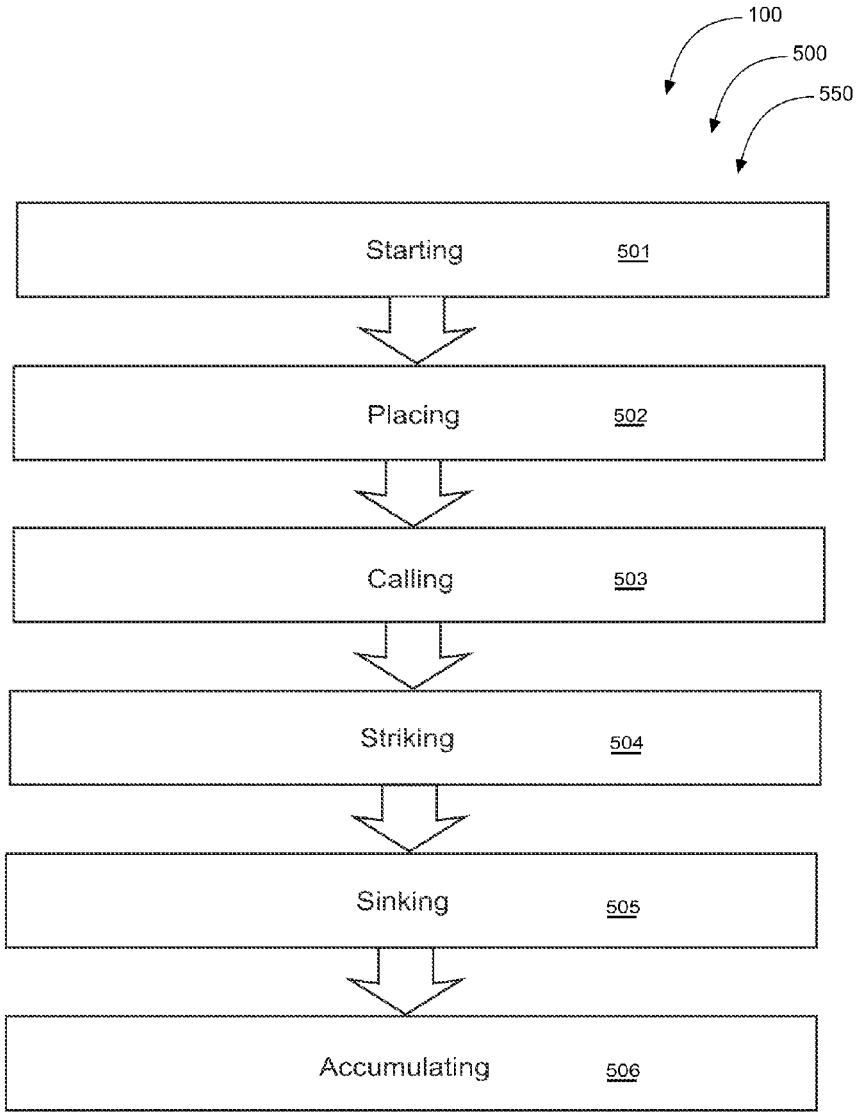
FIG. 5 is a flowchart illustrating a method of use according to an embodiment of the present invention of FIGS. 1-4C.

Referring now to FIG. 5, showing flowchart 550 illustrating method of use 500 according to an embodiment of the present invention of FIGS. 1-4C.

Method of use 500 for sharp shooter billiards system 100 may comprise the steps of: step one 501, starting a billiard-style game with two billiard balls 110 on billiard table 102; step two 502, placing a third billiard ball 110 on billiard table 102 to use as a cue ball; step three 503, calling a billiard ball in-play by the player whose turn it is; step four 504, striking the cue ball into the billiard ball in-play called by the player; step five 505, sinking the billiard ball in-play into head-end wall point-value pockets 205, left-side wall point-value pocket 210, or right-side wall point-value pocket 215; and step five 506, accumulating points to win the billiard-style game.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A sharp shooter billiards system comprising:

a billiard table comprising;
- a billiard table frame;
- a playing surface comprising a peripheral rail;
- a head-end wall comprising a first corner, a second corner, and a mid-point, said head-end wall comprising;
  - a plurality of head-end wall point-value pockets;
- a shooting-end wall;
- a left-side wall comprising;
  - a left-side wall point-value pocket;
- a right-side wall comprising;
  - a right-side wall point-value pocket;
- a pair of billiard table legs;

a ball return assembly comprising;
- a plurality of ball returns;
- a plurality of point denomination through-holes;
- a ledge; and
- a ball retaining rack;

wherein said billiard table and said ball return assembly comprises in combination said sharp shooter billiards system;

wherein said plurality of ball returns, said plurality of point denomination through-holes, said ledge, and said ball retaining rack comprises in combination said ball return assembly;

wherein said head-end wall, said left-side wall, said shooting-end wall, and said right-side wall define parameters of said billiard table frame;

wherein said playing surface is recessed within said billiard table frame;

wherein said peripheral rail of said playing surface is in contact with said head-end wall, said shooting-end wall, said left-side wall, and said right-side wall;

wherein said peripheral rail comprises a plurality of billiard ball openings providing ingress for at least one billiard ball to enter;

wherein said billiard ball openings are adjacent said plurality of head-end wall point-value pockets, said left-side wall point-value pocket, and said right-side wall point-value pocket;

wherein said head-end wall point-value pockets, said left-side wall point-value pocket, and said right-side wall point-value pocket are connected to said plurality of ball returns;

wherein said plurality of ball returns are connected to said plurality of point denomination through-holes;

wherein said point denomination through-holes allow said at least one billiard ball to pass there-through onto said ledge;

wherein said at least one billiard ball is displayable on said ball retaining rack during a non-use condition;

wherein said billiard table legs support said billiard table above a planar surface; and wherein a game is comprised of shooting said billiard ball(s) into said plurality of billiard ball openings by at least one player for accumulating points, said at least one player that accumulates a majority of said points played over a pre-determined duration wins said game.

2. The sharp shooter billiards system of claim 1 wherein said shooting-end wall of said billiard table is placeable directly adjacent a vertical wall in an interior room thereby conserving space.

3. The sharp shooter billiards system of claim 2 wherein said plurality of head-end wall point-value pockets, said left-side wall point-value pocket, and said right-side wall point-value pocket are located on a higher plane than said ledge of said ball return assembly such that gravity causes said at least one billiard ball to roll downward from said plurality of head-end wall point-value pockets, said left-side wall point-value pocket, and said right-side wall point-value pocket to said ledge.

4. The sharp shooter billiards system of claim 3 wherein said pair of billiard table legs comprises bowed leg stands to distribute weight sufficiently.

5. The sharp shooter billiards system of claim 4 wherein said pair of billiard table legs is bolted to an underside of said billiard table via a pair of bolts.

6. The sharp shooter billiards system of claim 5 wherein said billiard table has dimensions comprising approximately 4' by 8'.

7. The sharp shooter billiards system of claim 6 wherein said billiard table is formed of plywood and oak.

8. The sharp shooter billiards system of claim 7 wherein said playing surface comprises felt.

9. The sharp shooter billiards system of claim 8 wherein said peripheral rail of said head-end wall comprising at least one bumper located between each of said plurality of head-end wall point-value pockets.

10. The sharp shooter billiards system of claim 9 wherein at least two of said plurality of head-end wall point-value pockets comprises 25-point pockets.

11. The sharp shooter billiards system of claim 10 wherein said 25-point pockets are each located at said first corner located between said head-end wall and said left-side wall, and said second corner located between said head-end wall and said right-side wall.

12. The sharp shooter billiards system of claim 11 wherein at least two of said plurality of head-end wall point-value pockets comprises 5-point pockets.

13. The sharp shooter billiards system of claim 12 wherein each of said 5-point pockets are located adjacent said 25-point pockets.

14. The sharp shooter billiards system of claim 13 wherein at least one of said plurality of head-end wall point-value pockets comprises a 10-point pocket, said 10-point pocket located at said mid-point of said head-end wall.

15. The sharp shooter billiards system of claim 14 wherein at least one of said plurality of head-end wall point-value pockets comprises a 20-point pocket, said 20-point pocket located to a left of said mid-point between said 10-point pocket and said 5-point pocket.

16. The sharp shooter billiards system of claim 15 wherein at least one of said plurality of head-end wall point-value pockets comprises a 15-point pocket, said 15-point pocket located to a right of said mid-point between said 10-point pocket and said 5-point pocket.

17. The sharp shooter billiards system of claim 16 wherein said left-side wall point-value pocket and said right-side wall point-value pocket comprises 50-point pockets.

18. A sharp shooter billiards system comprising:

a billiard table having dimensions of approximately 4' by 8' comprising;

a billiard table frame;

a playing surface comprising a peripheral rail, said playing surface comprising felt;

a head-end wall comprising a first corner, a second corner, and a mid-point, said head-end wall comprising;

a plurality of head-end wall point-value pockets, said peripheral rail of said head-end wall comprising at least one bumper located between each of said plurality of head-end wall point-value pockets;

a shooting-end wall, said shooting-end wall of said billiard table is placeable directly adjacent a vertical wall in an interior room thereby conserving space;

a left-side wall comprising;

a left-side wall point-value pocket;

a right-side wall comprising;

a right-side wall point-value pocket;

a pair of billiard table legs, said pair of billiard table legs comprising bowed leg stands, said pair of billiard table legs bolted to an underside of said billiard table via a pair of bolts;

a ball return assembly comprising;

a plurality of ball returns;

a plurality of point denomination through-holes;

a ledge; and a ball retaining rack;

wherein said billiard table and said ball return assembly comprises in combination said sharp shooter billiards system;

wherein said plurality of ball returns, said plurality of point denomination through-holes, said ledge, and said ball retaining rack comprises in combination said ball return assembly;

wherein said head-end wall, said left-side wall, said shooting-end wall, and said right-side wall define parameters of said billiard table frame;

wherein said playing surface is recessed within said billiard table frame;

wherein said peripheral rail of said playing surface is in contact with said head-end wall, said shooting-end wall, said left-side wall, and said right-side wall;

wherein said peripheral rail comprises a plurality of billiard ball openings providing ingress for at least one billiard ball to enter;

wherein said billiard ball openings are adjacent said plurality of head-end wall point-value pockets, said left-side wall point-value pocket, and said right-side wall point-value pocket;

wherein said head-end wall point-value pockets, said left-side wall point-value pocket, and said right-side wall point-value pocket are connected to said plurality of ball returns;

wherein said plurality of ball returns are connected to said plurality of point denomination through-holes;

wherein said point denomination through-holes allow said at least one billiard ball to pass there-through onto said ledge;

wherein said plurality of head-end wall point-value pockets, said left-side wall point-value pocket, and said right-side wall point-value pocket are located on a higher plane than said ledge of said ball return assembly such that gravity causes said at least one billiard ball to roll downward from said plurality of head-end wall point-value pockets, said left-side wall point-value pocket, and said right-side wall point-value pocket to said ledge;

wherein at least two of said plurality of head-end wall point-value pockets comprises 25-point pockets;

wherein said 25-point pockets are each located at said first corner located between said head-end wall and said left-side wall, and said second corner located between said head-end wall and said right-side wall;

wherein at least two of said plurality of head-end wall point-value pockets comprises 5-point pockets;

wherein each of said 5-point pockets are located adjacent said 25-point pockets;

wherein at least one of said plurality of head-end wall point-value pockets comprises a 10-point pocket, said 10-point pocket located at said mid-point of said head-end wall;

wherein at least one of said plurality of head-end wall point-value pockets comprises a 20-point pocket, said 20-point pocket located to a left of said mid-point between said 10-point pocket and said 5-point pocket;

wherein at least one of said plurality of head-end wall point-value pockets comprises a 15-point pocket, said 15-point pocket located to a right of said mid-point between said 10-point pocket and said 5-point pocket;

wherein said left-side wall point-value pocket and said right-side wall point-value pocket comprises 50-point pockets;

wherein said at least one billiard ball is displayable on said ball retaining rack during a non-use condition;

wherein said billiard table legs support said billiard table above a planar surface; and wherein a game is comprised of shooting said billiard ball(s) into said plurality of billiard ball openings by at least one player for accumulating points, said at least one player that accumulates a majority of said points played over a pre-determined duration wins said game.

19. The sharp shooter billiards system of claim 18 comprising a kit including:

said billiard table;

said pair of billiard table legs;

said bolts for mounting said billiard table to said billiard table legs;

said billiard balls; and a set of user instructions.

* * * * *